United States Patent [19]

Skrmetta

[11] Patent Number: 4,835,942

[45] Date of Patent: Jun. 6, 1989

[54] SEAFOOD VACUUM-PACK SYSTEM

[76] Inventor: Raphael Q. Skrmetta, 4314 Bancroft Dr., New Orleans, La. 70122

[21] Appl. No.: 67,715

[22] Filed: Jun. 26, 1987

[51] Int. Cl.[4] ..... H05B 6/80; B65B 55/06

[52] U.S. Cl. ..... 53/453; 53/456; 53/559; 426/107

[58] Field of Search ..... 53/453, 559, 560, 561, 53/456; 426/107, 234, 243; 219/10.55 E

[56] References Cited

U.S. PATENT DOCUMENTS

| | | | |
|---|---|---|---|
| 3,343,332 | 9/1967 | Mahaffy et al. | 53/453 X |
| 3,347,011 | 10/1967 | Lovas et al. | 53/453 X |
| 3,526,186 | 9/1970 | Cornelius | 53/453 X |
| 4,416,906 | 11/1983 | Watkins | 426/107 |
| 4,684,025 | 8/1987 | Copland et al. | 53/453 X |
| 4,704,510 | 11/1987 | Matsui | 219/10.55 E |

FOREIGN PATENT DOCUMENTS

| | | | |
|---|---|---|---|
| 57-12228 | 1/1982 | Japan | 219/10.55 E |

*Primary Examiner*—James F. Coan
*Attorney, Agent, or Firm*—C. Emmett Pugh

[57] ABSTRACT

A vacuum packed, frozen, cooked or non-cooked shrimp pack, in which the shrimp-containing plastic pouch has a center thickness less than its outer, surrounding periphery, with more shrimp contained one above the other at the peripheral edges in comparison to a lesser number at the center in the pack. This produces a relatively even heating or cooking of the shrimp when the frozen pack is placed in a micro-wave for defrosting or cooking. Such a pack can be produced by providing an upwardly curved, rigid form underneath the bottom film layer of the pack in the "form, fill and seal" machine during commercial packing of the product in the sealing station and, if so desired, in the forming and fill stations. The rigid form can be provided by a curvi-linear section (FIG. 4) or a hemispherical section (FIGS. 5A & 5B) which presents a convexly curved surface on its upper side, which causes the bottom layer of the flexible film to be bowed up at its center area and flared downwardly at at least two of its opposed peripheral areas. This causes the shrimp or other highly sensitive food produce to be pushed out from the center during the sealing of the tightly fitting plastic pouch.

15 Claims, 2 Drawing Sheets

SEAFOOD VACUUM-PACK SYSTEM

BACKGROUND OF INVENTION

1. Field of Invention

The present invention relates to a method of vacuum packing frozen seafood and more particularly to a method of and apparatus for vacuum packing frozen peeled shrimp, cooked or uncooked, and the like to produce, for example, even microwave cooking, and an apparatus therefor which includes forming means for forming the packet for the seafood with a smaller thickness in its central area in comparison to its peripheral areas, and further to the resulting pack therefrom.

2. Prior Art & General Background

With respect to food technology generally, it is well known to provide vacuum packed food in packets or pouches for defrosting and cooking of the frozen food in boiling water or in a microwave. In such packing, the packed food is contained in a transparent plastic package made of barrier film, i.e. a film which holds a vacuum and does not "breathe," and the food, while still in its package, is cooked or at least defrosted. Classic examples of such food packaging for immediate home use in for example a microwave oven are the food packages provided by Stouffer's.

In the commercial packaging of such food products, the packs are formed on a continuous, mass production basis, in which upper and lower barrier films are provided with the food placed between them on the lower film, and the individual packets evacuated and sealed and separated. Machines which are used for such packing are called "form, fill and seal" machines.

However, in attempting to apply such technology to the packing of for example frozen, peeled shrimp, which is a highly heat sensitive food product, it was found that such technology did not work, and the end food product, when cooked or defrosted in the package, was heated unevenly. In particular, the shrimp located in the center were under cooked or heated, while on the other hand the shrimp at the peripheral edges were over cooked or heated, by the microwave unit. As a result, such technology has not heretofore been available for products such as shrimp.

One of the problems noted by the inventor was that such machines tended to cause the shrimp to be relatively bunched up in the center of the package in the final sealing step.

General, Summary Discussion of the Invention

The present invention overcomes this prior art problem by providing a system which is highly reliable, relatively economical and very cost effective, in which the shrimp or other like food product is packed in the plastic container with a lesser density in the central area and a greater density in the peripheral areas, preferably with a smooth, curved transition in densities between the extremities.

In the preferred embodiment this pack is produced by forming the bottom pouch film layer with a raised portion in its center flowing out to a maximum thickness at at least two of its opposed peripheral edges. Such a forming of the pouch can be created by placing the bottom film layer on a form, which is for example either spherically or curvi-linearly shaped, the latter being made for example from a cylindrical section. The resulting pack then has a greater number of shrimp and hence a greater density at its peripheral areas and a lesser number and hence a lesser density at its center.

Thereafter, when the frozen shrimp pack is placed in a microwave and heated, the resulting food product comes out relatively evenly cooked throughout, producing a very tasty, convenient food product for the consumer.

Although the invention has been found to be particularly effective for shrimp, the principles thereof could be applied to other food products, particularly those which are highly heat sensitive, such as for example seafood, and which are packed in a manner that the contents are subject to be rearranged and spread out with respect to itself and hence fungible. For example a typical, rectangular shrimp pack of for example five inch by six inch size (when viewed in its lateral extent from a top perspective) might contain approximately twenty to sixty individual shrimp, allowing the contents to be moved about to produce the varying densities in the pack taught in the present invention. Other exemplary seafood products would include crawfish, minced fish, small fish (e.g. sardines), crab meat, oysters, etc.

It is thus a basic object of the present invention to provide a vacuum packed food pack of highly heat sensitive frozen food product(s) which has a lesser food density in its central area in comparison to its surrounding areas, to produce an evenly heated product when heated in for example a microwave oven, an exemplary food product being frozen, peeled shrimp.

BRIEF DESCRIPTION of the DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION of the PREFERRED, EXEMPLARY EMBODIMENT(S)

Figure 1:
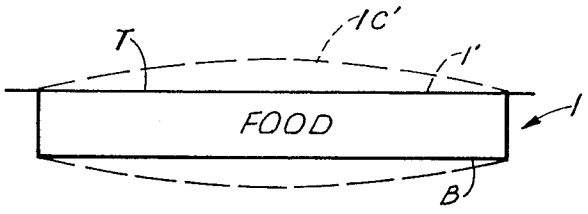
FIG. 1 (PRIOR ART)
FIG. 1 is a side view of an exemplary, prior art vacuum packed, frozen food pack with variation(s) thereof being shown in phantom line.

As can be seen in FIG. 1, a typical, exemplary, vacuum packed frozen food pouch or packet 1 ideally (in prior art terms) contains an evenly distributed food product having a rectangular, side cross-section, as illustrated in solid line in the drawing. However, in fact, the "form, fill and seal" machines used often produce a packet 1' having in side configuration a convexly curved, thicker depth in its central region 1C'. This is caused by the action of the bottom and/or the top film layer(s) B & T, respectively, pushing the contained food in toward the center during the vacuum sealing stages as the film(s) shrink inward.

Such a prior art pack, although apparently fine for most food products, causes an unacceptable, unevenness of heating of the product, when used for a highly heat sensitive food product such as for example frozen, peeled shrimp. For example, the heat sensitive food will be overly cooked or heated at the peripheral area 1P, in comparison to the insufficiently heated or cooked central, thicker area 1C.

Figure 2:
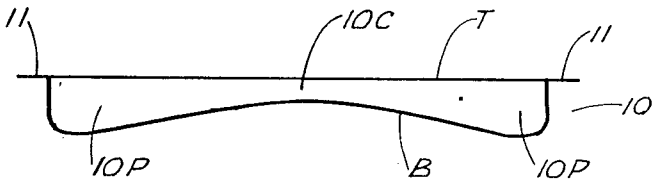
FIG. 2 is a side view of the preferred embodiment of the varying density, vacuum packed, frozen food pack of the present invention, similar in perspective to that of FIG. 1, for comparison purposes.

In contrast, with reference to FIG. 2, the preferred, exemplary food pack 10 produced in the present invention has a smaller, less thick dimension in its central area 10C, in comparison to the larger, thicker, peripheral or surrounding areas 10P. Preferably, as illustrated, there is a smooth, curved progression of varying thicknesses from the central area 10C to the outer, surrounding, peripheral areas 10P, at least with respect to two, opposed edges.

Such a pack 10 has a higher density of container food F at the peripheral areas 10P, in comparison to the central area 10C. Thus, for example, in the preferred, exemplary application of frozen, peeled shrimp (cooker or uncooked), there are a greater number of shrimp one above the other in the peripheral areas 10P, than in the central area 10C.

An exemplary shrimp pack having a size of approximately five inches by six inches could have a count of approximately twenty to sixty shrimp, with the central portion 10C having a thickness of about three-eights of an inch and with the peripheral, maximum thickness portion 10P having a thickness of about five-eights of an inch, although of course these particular dimensions are subject to great variation.

Figure 3:
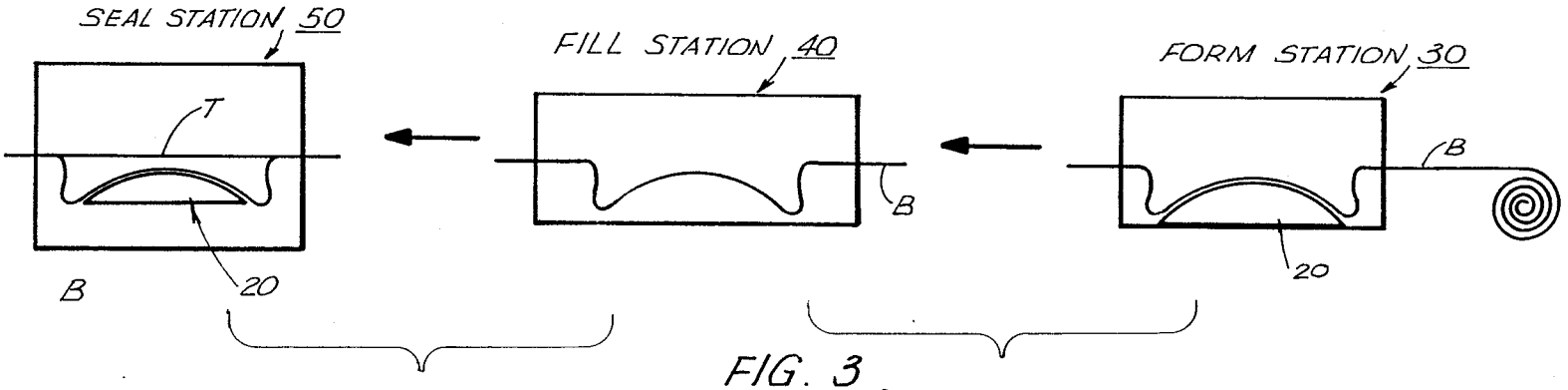
FIG. 3 is a simplified, flow chart or schematic type view showing the three stages of an exemplary "form, fill and seal" machine incorporating the bottom forming techniques and forms of the present invention, used to produce the packet configuration of FIG. 2.

With reference to FIG. 3, this contoured package 10 for example could be produced by including a rigid form 20, preferably convexly curved, in at least the sealing structure 50 underneath the lower or bottom layer B of the barrier film forming the ultimate pouch or packet 10. This then causes the shrimp or other food product to be properly distributed when sealed in the desired density distribution described above, during the evacuation and sealing steps. Once so sealed, the package 10 maintains its density distribution under the tautness of the sealed top and bottom film layers T & B.

It is noted that in the sealing station 50 the area between the film layers T & B is evacuated and the peripheral edges surrounding each pack are sealed together, producing the relatively flat surrounding peripheral strip 11. Usually more than one pack, for example a grouping of four or six or eight packs, is processed in the sealing station 50 at a time. A form 20 is included at the underside of each pack located centrally underneath it. Exemplary "form, fill and seal" machines are marketed under the brand name "TIROMAT" and also by the Mahaffy & Harder Company.

If desired, such rigid forms 20 could also be included in the forming or form station 30, as illustrated, in order to pre-form the concavity of the bottom layer B of the film, before the food product is added at the subsequent fill station 40. Such inclusion further insures that the desired density distribution of the ultimately packaged product will result.

Figure 5A:
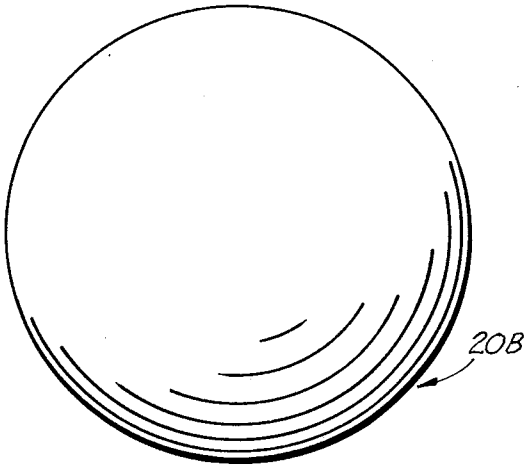
Figure 5B:
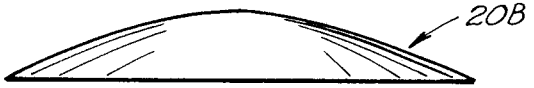
Figure 4:
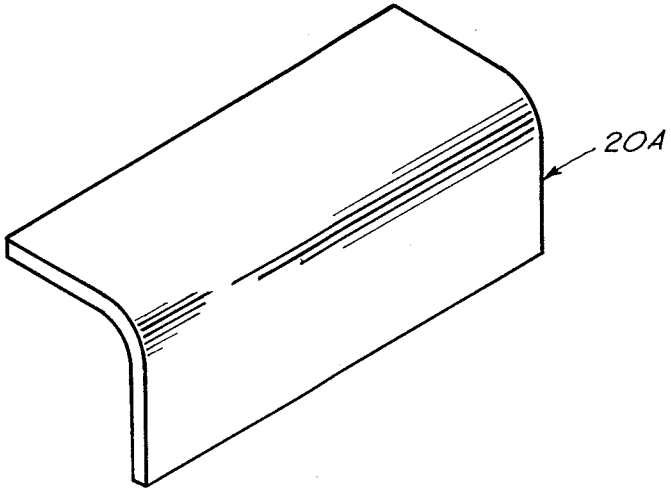
FIG. 4 is a top perspective view of a first, exemplary, curvi-linear embodiment of a form which can be used in the machine of FIG. 3 to form a curved bottom in the packet; while FIGS. 5A & B are top and side views, respectively, of a second, exemplary, hemispheric embodiment of a form which can be used in the machine of FIG. 3 to form a curved bottom in the packet.

Two exemplary embodiments 20A & 20B for the rigid form(s) 20 are illustrated in FIGS. 4 and 5A & 5B, respectively.

As seen in FIG. 4, the first exemplary embodiment 20A is made of a longitudinally extended, rigid plate bent along its centerline presenting a curvi-linear, convex surface on its upper side. Alternatively, a curved, cylindrical section could be used. When placed under the bottom layer B of the barrier film, it causes the flexible film to be bowed up in its central area to produce the reduced center portion 10C and relatively downwardly flared, peripheral portions 10P at two of its opposed peripheral edges. If desired, such a longitudinally extended form 20A could be extended in one or more sections to effectively reach all the way through the filling station 40 to and within the final sealing station 50, so that the center portion of the bottom film layer B is always supported in its centrally bowed up configuration throughout the machine.

As seen in FIGS. 5A (top view) & 5B (side view), the second exemplary embodiment 20B is made of a rigid, hemispherical section or at least a "flatten," near "hemispherical" section, both of which present a fully curved, convex surface on their upper sides. When placed under the bottom layer B of the barrier film, the form 20B causes the film to be bowed up in its central area to produce the reduced center portion 10C and relatively downwardly, peripheral portions 10B at all four of its opposed peripheral edges.

Such rigid forms 20 are necessary when the packing material for the pouches is in the form of flexible, non-rigid film. However, if the material is provided in the form of a relatively, form-holding material, the bowed bottom (and/or top) could be pre-formed independently of the packaging machine to produce the desired density varying distribution result described above with reference to FIG. 2.

Although for illustrative purposes the bowing in the foregoing embodiments was always on the bottom film layer B, alternatively or conjunctively the top film layer T could be bowed downwardly or inwardly, the primary goal being the desired density distribution of less in the center and more in the surrounding areas up to and including the very peripheral edges for the contained or packaged food product.

After the packed frozen shrimp leave the sealing station 50, they are ultimately provided to the consumer for eating when desired. When such is desired, the consumer merely places the packet 10 in the micro-wave, and, for pre-cooked shrimp, the packet is defrosted or thawed in the micro-wave in approximately an exemplary one minute. For frozen, non-cooked shrimp, the packet 10 is cooked in the micro-wave for an exemplary three to four minutes.

It is noted that the drawings have been somewhat simplified for illustrative purposes and the nicely defined perfectly curved line for the underside of the packet 10 is not absolutely necessary. Indeed, in reality the film will tend to cling up and around the enclosed food items, such as for example the rounded bodies of the shrimp, but of course the package will still have the desired distribution of more shrimp one above the other at the peripheral edges 10P that in the center 10C.

The embodiments described herein in detail for exemplary purposes are of course subject to many different variations in structure, design, application and methodology. Because many varying and different embodiments may be made within the scope of the inventive concept(s) herein taught, and because many modifications may be made in the embodiments herein detailed in accordance with the descriptive requirements of the law, it is to be understood that the details herein are to be interpreted as illustrative and not in a limiting sense.

What is claimed is:

1. A vacuum pack of highly heat sensitive frozen food product made up of separate pieces of product packed one above the other, such as shrimp or other like seafood or other relatively moveable, fungible food products, comprising:

a sealed, evacuated package having a greater thickness at its surrounding, relatively peripheral portions in comparison to the thickness of its central portion, there being a greater number of separate pieces of frozen product packed one above the other in said peripheral portions that in its central portion, allowing the separate pieces of highly heat sensitive food product to be relatively evenly heated when heated in a micro-wave unit.

2. The vacuum pack of Claim 1, wherein the bottom of said packaged is bowed up in its central portion in relation to its peripheral portions.

3. The vacuum pack of claim 2, wherein said package is formed from two flexible layers of barrier sheet film material sealed together, tightly holding the contained, otherwise movable food products together between said two flexible layers, with portions of said film layers being wrapped up and around portions of said separate pieces of food products located next to said flexible layers, maintaining the relative positions of said separate pieces of food products of the contained food product from the time it was evacuated up to the time the pack is placed in the micro-wave for heating.

4. The vacuum pack of claim 1, wherein the food product is shrimp, the pack is about five inches by about six inches in its lateral extent, and about twenty to about sixty count of the shrimp are contained in the pack.

5. In a "form, fill and seal" machine for packaging highly heat sensitive, relatively moveable, individual pieces of frozen food products between two, non-rigid, flexible layers of barrier film material, a bottom film layer and a top film layer, which are ultimately sealed together to enclose the food products between the film layers, the improvement comprising:

a rigid, form placed in the seal station of the machine to underlie the bottom, non-rigid, flexible, film layer of barrier material, said form having a convexly curved, upper surface causing the bottom layer of barrier film material under its own weight to drap down and to become bowed in in its central area and downwardly flared in its peripheral portion producing a sealed package having a thinner dimension in its central area in comparison to a thicker dimension in its relatively surrounding peripheral areas.

6. In a "form, fill and seal" machine for packaging highly heat sensitive, relatively moveable, frozen food products between two layers of barrier material, a bottom layer and a top layer, which are ultimately sealed together to enclose the food products, the improvement comprising:

a rigid, form placed in the seal station of the machine to underlie the bottom layer of barrier material, said form having a convexly curved, upper surface causing the bottom layer of barrier material to be bowed in in its central area and downwardly flared in its peripheral portion producing a sealed package having a thinner dimension in its central area in comparison to a thicker dimension in its relatively surrounding peripheral areas; said form having a longitudinally extended body bent in its middle forming said convexly curved, upper surface of said form.

7. In a "form, fill and seal" machine for packaging highly heat sensitive, relatively moveable, frozen food products between two layers of barrier material, a bottom layer and a top layer, which are ultimately sealed together to enclose the food products, the improvement comprising:

a rigid, form placed in the seal station of the machine to underlie the bottom layer of barrier material, said form having a convexly curved, upper surface causing the bottom layer of barrier material to be bowed in in its central area and downwardly flared in its peripheral portion producing a sealed package having a thinner dimension in its central area in comparison to a thicker dimension in its relatively surrounding peripheral areas; said form having a longitudinally extended, cylindrical section body forming said convexly curved, upper surface of said form.

8. The improvement of claim 5, wherein said form has a body made from a hemispherical section forming said convexly curved, upper surface of said form.

9. The improvement of claim 5, wherein another one of said forms is placed in the forming station of the machine, preforming the bottom layer prior to filling of the food product.

10. The improvement of claim 9, wherein said forms are provided in the form of a longitudinally extended body underlying the bottom layer from the forming station through the filling station to and in the sealing station.

11. A method of vacuum packaging highly heat sensitive, separate pieces of relatively movable food products, such as shrimp or other like seafood or other relatively moveable, fungible food products, comprising the following step(s):

(a) packaging the shrimp or other relatively moveable, separate pieces of food products one piece above the other in a micro-waveable food package in which the food product is distributed with a greater number of separate pieces in its surrounding, relatively peripheral areas in comparison to it central area, producing a varying density of food product within the package; and (b) tightly sealing the packaging material about the food product holding it in its varying density distribution for ultimate micro-waveing in such density varying distribution.

12. The vacuum packing method of claim 11, wherein in step "a" there is included the step(s) of:

(a-i) using a flexible film for forming at least one side of the package and a rigid form in contact with the flexible film with said form having a convexly curved surface on the side facing the flexible film, and placing the form against the flexible film causing it to be bowed inward in its central area.

13. The vacuum packing method of claim 12, wherein in step "a-i" there is included the step(s) of:

utilizing a "form, fill and seal" machine and utilizing said form in at least the sealing station of the "form, fill and seal" machine.

14. The vacuum packing method of claim 13, wherein in step "a-i" there is included the step(s) of:

also utilizing said form in the forming station of the "form, fill and seal" machine.

15. The vacuum packing method of claim 12, wherein in step "a" there is included the step(s) of:

(a-i) using a pre-formed, relatively form-holding element having a relatively bowed in central portion in relation to its surrounding, relatively peripheral portions, and filling said element with the food product with a greater number of separate pieces of food product one above the other, producing a greater density distribution in the surrounding, relatively peripheral portions in comparison to its central portion.

* * * * *